US006488614B1

(12) United States Patent
Chang

(10) Patent No.: US 6,488,614 B1
(45) Date of Patent: Dec. 3, 2002

(54) CYCLE TYPE WAIST SLIMMER MACHINE

(76) Inventor: Chuan-Pin Chang, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/904,494

(22) Filed: Jul. 16, 2001

(51) Int. Cl.[7] ..... A63B 21/22; A63B 21/02
(52) U.S. Cl. ..... 482/110; 482/126; 482/122
(58) Field of Search ..... 482/92, 93, 97, 482/140, 128, 122, 125, 126, 110

(56) References Cited

U.S. PATENT DOCUMENTS 5,160,304 A * 11/1992 Van Der Hoeven ..... 482/128
5,651,755 A * 7/1997 Chen ..... 482/128
5,695,436 A * 12/1997 Huang ..... 482/121
5,700,232 A * 12/1997 Clausen et al. ..... 482/125
5,749,815 A * 5/1998 Lipps ..... 482/122
5,913,756 A * 6/1999 Glaser ..... 482/128
6,193,638 B1 * 2/2001 Barrett ..... 482/128
6,206,811 B1 * 3/2001 Lat ..... 482/126

* cited by examiner

*Primary Examiner*—Jerome W. Donnelly
*Assistant Examiner*—Fenn Mathew
(74) *Attorney, Agent, or Firm*—Troxell Law Office PLLC

(57) ABSTRACT

A cycle waist slimmer machine, wherein its main body is a long rod, at each end of the long rod is a pressure component to press down at the user's abdomen, another heavy thing is a rope-like object which is threaded through the corresponding ends of the pressure components which are at both ends of the long rod, when in use, the user holds the handles at both sides of the long rod, and then uses the pressure components to press down at the abdomen in order to allow the heavy thing at the other end of the long rod to turn, the user can, in conjunction with the centrifugal force created by the turning of the heavy thing as well as the size of the movement of turning to change the angle of the turning of the heavy thing, to achieve the results, fun-wise and health-wise.

8 Claims, 4 Drawing Sheets

CYCLE TYPE WAIST SLIMMER MACHINE

BACKGROUND OF THE INVENTION

1) Field of the Invention

The present invention relates to a cycle type waist slimmer machine, which can provide massage to the user's abdomen and waist areas, in particular, it is a exercise machine that can exercise the waist by turning the waist sideways.

2) Description of the Prior Art

In our busy society, where the average person knows the importance of getting enough exercise yet do not have the time for sorely lacks exercise, where the fee for using exercise centers is usually exorbitant, coupled with the fact that a lot of exercise machines are no fun, these factors can cause a person to find this thing dull and even unwilling to use them, after a time, these people may lose the motivation and the interest in exercising altogether.

In addition, the living space has grown smaller and smaller, the exercise machines in the market are big and heavy, making it impossible for the average family to install one in their homes, also the high cost of these machines also prohibits the majority to buy these machines, moreover, the functions of some of these machines cause people to lose interest in them, even after only three or four uses, resulting in waste of money and space.

SUMMARY OF THE INVENTION

The primary objective of the present invention is to provide a type of cycle waist slimmer machine, wherein its main body is a long rod, at one end of the long rod is a pressure component to press down at the user's abdomen, at another end is a heavy rope-like object. When this machine is in use, the user should use both hands to hold the handles located at both sides of the long rod, and then use the pressure components to press down at the abdomen in order to allow the heavy object at the other end of the long rod to turn. The user can, in conjunction with the centrifugal force created by the turning of the heavy object as well as the size of the movement of turning to change the angle of the turning of the heavy object, achieve the results, fun-wise and health-wise. Also because during the use of said exercise machine, it is necessary to utilize the strength of the waist area to lift the heavy object at the other end of the long rod, and twist the waist area to cause the heavy object to turn, not only does this enhance the strength of the waist, it also causes the waist to slim down, which is the main purpose.

The other objective of the present invention is in that the hollow middle part of the long rod has an elastic component, perpendicular to the rope like object which passes through the pipe's hollow middle and is connected to one end of the elastic component, when the user's turning speed has already causes the turning of the heavy object to speed up and the rate to go up, said elastic component can be pulled longer and longer due to the object's centrifugal force, and because the elastic component is pulled longer and longer, the rope like object is able to extend more in addition, the swinging rate of the heavy object can increase the exercise results of said machine.

The further objective of the present invention is that on both protuberant sides of the long rod is a linking harness that can be connected to the handles, and there are which can placed one on top of the other located in the connection between the handles and the linking harness. In addition, in the middle connection of the linking harness are fixed buttons, such that when the handle is connected to the linking harness, the fixed buttons allow the handle and linking harness to stay in place and also allows the handles to be one with the long rod. When the machine is not in use, the handles, pressure component, and long rod can be disassembled, making the length and volume more convenient to store and transport.

DETAILED DESCRIPTION OF THE PREFERRED EMBODIMENTS

Figure 1:
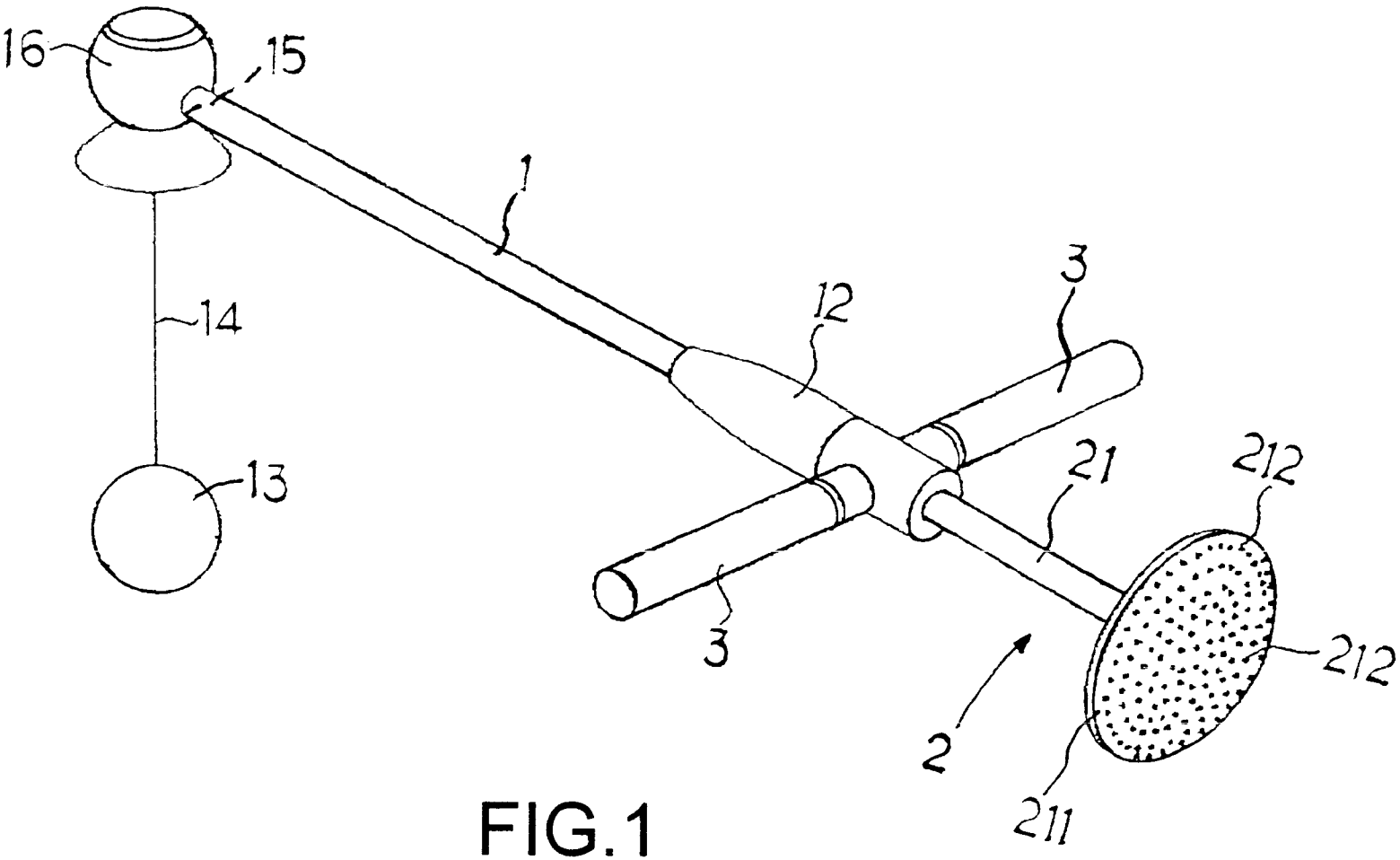
FIG. 1 is an external structural drawing of the invention herein.
Figure 3:
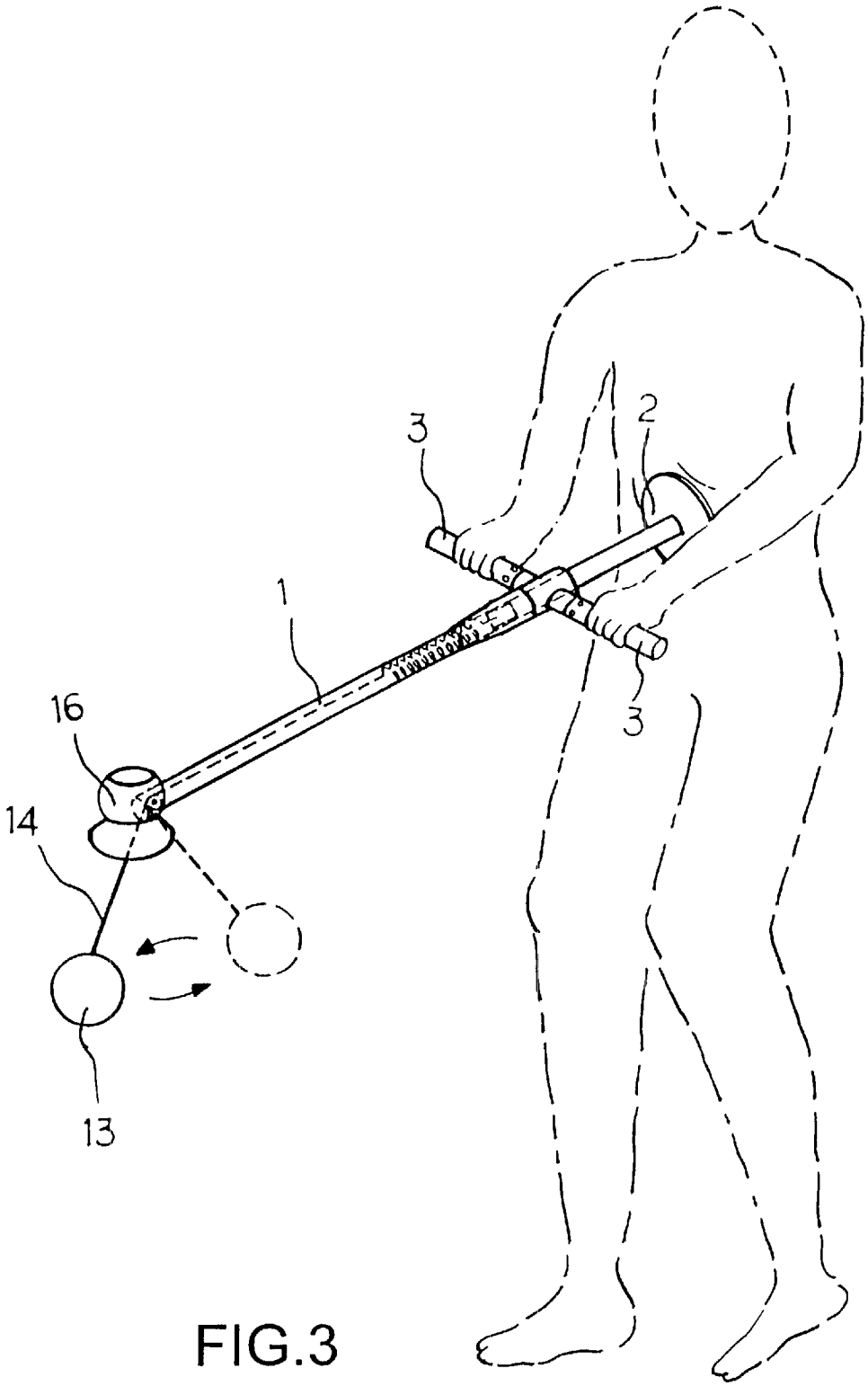
FIG. 3 is an illustration of the utilization of the invention.

The basic structure of the present invention, as seen from FIG. 1, consists of a long rod (1), one sheathed end of the long rod (1) has a pressure resisting component (2) which is placed at the user's abdomen, at both sides of the long rod (1) are handles (3) with protuberances facing which the user may use to hold himself. Aside from that, there is a heavy object (13), which is made up of a restraining unit (14) threaded through the corresponding pressure-resisting component (2) at the end of the long rod (1). When the exercise machine is in use, as seen in FIG. 3, the user may use both hands to hold on to the handles (3) on both sides of the long rod (1), and then place the pressure resisting component (2) on the abdomen to allow the heavy object (13) at the other end of the long rod (1) to turn in the air, and then with the turning movement move the waist area and bring about the turning motion of the heavy object (13) at the other end of the long rod (1). The user can, in conjunction with the centrifugal force created by the turning of the heavy object as well as the size of the movement of turning to change the angle of the turning of the heavy object, to achieve the results, fun-wise and health-wise. Moreover, the machine in use utilizes the strength of the waist to prop up the heavy object (13) at the other end of the long rod (1), and the twisting of the waist lets the heavy object (13) revolve, resulting in the training of the abdominal muscles as well as achieving slimming results.

Figure 2:
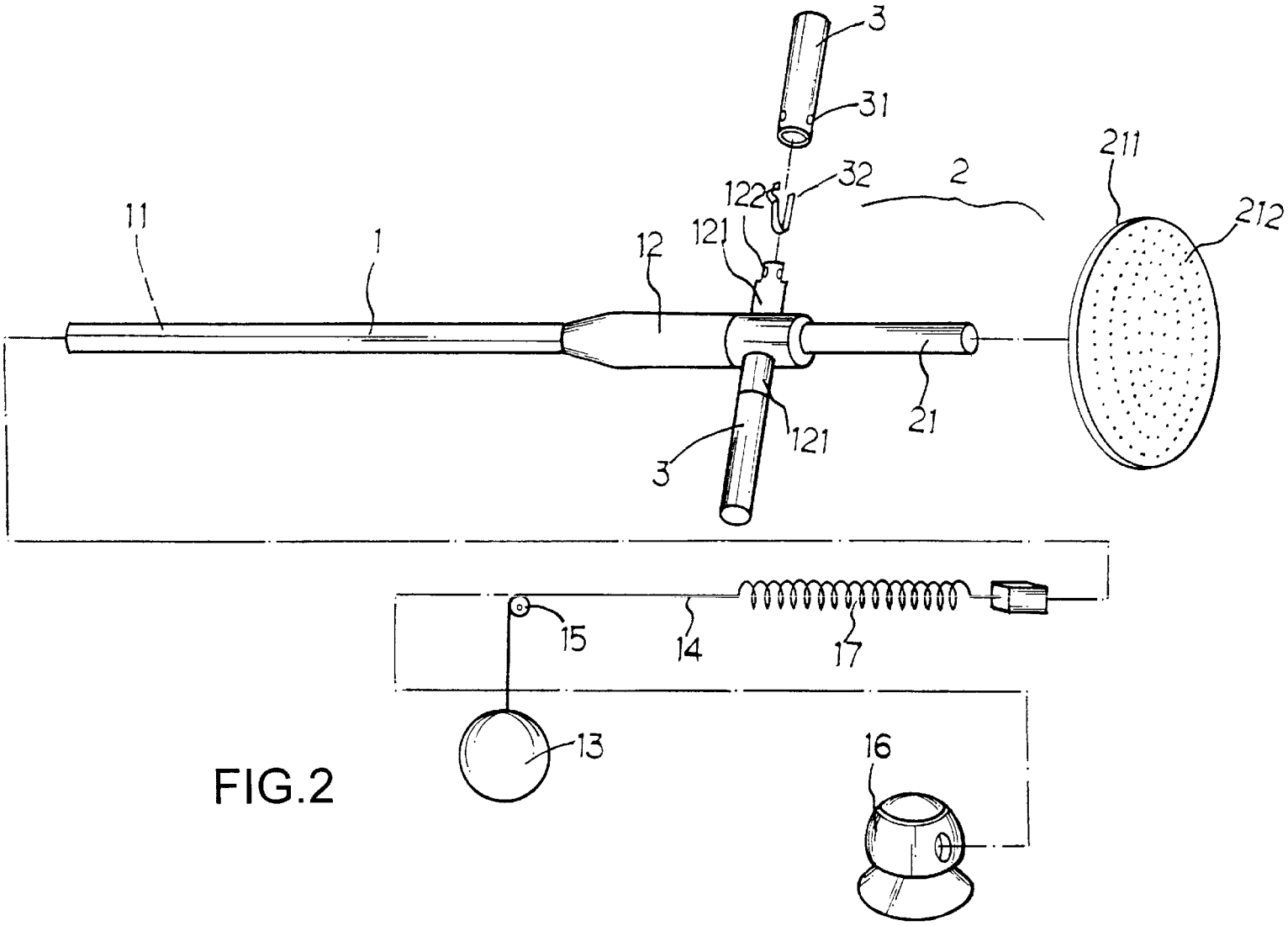
FIG. 2 is a structural breakdown drawing of the invention.
Figure 4:
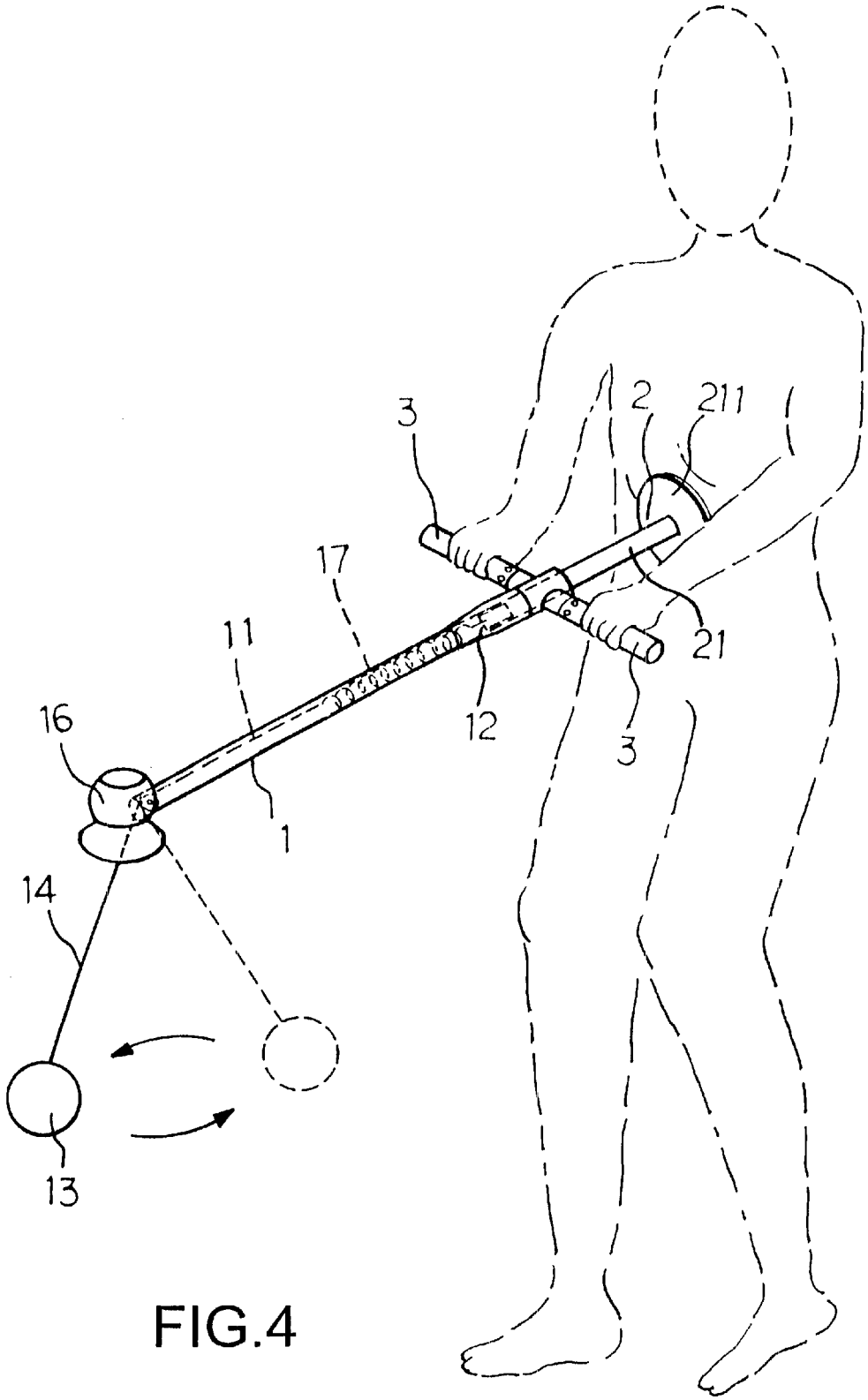
FIG. 4 is an illustration of another utilization of the invention.

Referring to both FIGS. 1 and 2 at the same time, the long rod has a basic hollow tubing structure (11), which can be used with an elastic component (17) sheathed by the hollow tubing (11), this makes it easier for the restraining unit (14) hung perpendicular to the heavy object (13) to penetrate the hollow tubing (11) and be connected with one end of the elastic component (17). While the heavy object (13) is revolving, as seen from FIG. 4, when the user increases the speed of the twisting motion, it also increases the speed of the revolving heavy object (13). Through the centrifugal force produced by the heavy object (13), the elastic component (17) will slowly be pulled longer and through the lengthening of the elastic component (17), the restraining unit will also be stretched more, which can increase the swinging rate of the heavy object (13), thereby also adding to the exercise functions of the machine. Moreover, the restraining unit (14) can be formed by the elastic restraining unit, which can achieve the same uses.

Aside from this, the sheath base (16) at the front end of the long rod (1), the restraining unit (14) shall penetrate the sheath base (16) and directly be connected to the elastic component (17) of the hollow tubing (11), when the elastic component (17) contracts, the restraining unit (14) will be hidden into the hollow tubing (11) of the long rod (1) at the same time, and the sheath base (16) shall frame the heavy object (13) to hold it in a fixed position, preventing the heavy object from rocking and adding to the comprehensiveness of the whole structure. At the mouth of the tubing connecting the long rod (1) and the sheath base (16) is a guiding wheel (15), which makes the expansion and contraction of the restraining unit (14) smoother, also when the heavy object (13) revolves, it decreases the friction between the restraining unit's (14) and the mouth of the long rod (1), preventing the wear and tear of the restraining unit (14).

There is a bore sheath (12) at the end of the heavy object (12) which corresponds to the long rod (1), the pressure resisting component (2) has a piercing rod (21) which goes through the bore sheath (12) to connect with the long rod (1), moreover, at the tail end of the piercing rod (21) of the restraining unit, there is a pressure prop unit (211) which is responsible for diverting the restraining unit (2), increasing the degree of comfort during the use of the machine, the surface of pressure prop unit (211) facing the user has protuberant pellets (212). With the pressure prop unit (211) pressed on the abdomen of the user, aside from the protuberant pellets being able to increase the attachment of the pressure prop unit (211) to the abdomen, the protuberant pellets also massage the abdomen. At the same time, there is an elastic component (not shown in drawing), which can be placed between the pressure-resisting component and the long rod to allow the user to better massage the abdomen.

Once again, the handles (3) on both sides of the long rod (1) may be removed, where the long rod (1) has two side protuberances, sheath connectors (121) that may be connected to the handles (3), the sheath connecting position of the handles (3) and sheath connectors (121) have, respectively, holes (31), (122) that can be located on top of the other, in the center of the sheath connector (122), there is a fixed button (32) which can be locked into the holes (31), (122) at the same time, so that when the handle (3) and the sheath connectors (121) are hooked together, the fixed button (32) may lock the handles (3) and the sheath connectors (121) into position, resulting in the handles (3) and long rod (1) becoming one. Moreover, when the machine is not in use, the handles (3), pressure-resisting component (2), and long rod (1) can be disassembled, making the length and volume more convenient to store and transport.

What is claimed is:

1. A cycle type waist slimmer machine comprising:

an elongated rod, with two side handles facing outwards, a pressure-resisting component mounted on a first end of the elongated rod, configured to press against an abdomen of a user; and, a heavy object attached to a restraining unit connected with and extending through a second end of the elongated rod, whereby the heavy object may move relative to the second end of the elongated rod when a user grips the side handles on both sides of the elongated rod, and places the pressure resisting component on the abdomen whereby movement of a user's waist area brings about turning motion of the heavy object.

2. The cycle type waist slimmer machine according to claim 1, wherein the elongated rod comprises a hollow tubing structure, and further comprising an elastic component located within the hollow tubing connected with the restraining unit, such that, in use, when the user increases the speed of the twisting motion, it also increases a speed of the revolving heavy object, whereby centrifugal force produced by the heavy object, elongates the elastic component to increase a swinging rate of the heavy object.

3. The cycle type waist slimmer machine according to claim 2, further comprising a sheath base at the first end of the elongated rod, with the restraining unit penetrating the sheath base and directly connected to the elastic component such that, when the elastic component contracts, the restraining unit will be hidden in the hollow tubing of the elongated rod, and the sheath base shall hold the heavy object in a fixed position; and at the second end of the elongated rod is a guiding wheel, over which the restraining unit passes, making the movement of the restraining unit smoother.

4. The cycle type waist slimmer machine according to claim 1, further comprising a bore sheath at the first end of the elongated long rod, the pressure resisting component having a bore rod which extends through the piercing sheath and connects with the elongated rod, moreover, and a pressure prop unit mounted on the piercing rod, a surface of pressure prop unit facing the user has protuberant pellets such that, with the pressure prop unit pressed against the abdomen of the user, the protuberant pellets increase the attachment of the pressure prop unit to the abdomen, and massage the abdomen.

5. The cycle type waist slimmer machine according to claim 1, wherein two side handles are removable and wherein the elongated rod has two sheath connectors removably connected to the handles, the handles and sheath connectors having, respectively, holes located on top of each other, and further comprising, in a center of the sheath connectors, fixed buttons removably engaging the holes at the same time, so that the handle and the sheath connectors are hooked together.

6. The cycle type waist slimmer machine according to claim 1, wherein, the restraining unit is an elastic restraining unit.

7. The cycle type waist slimmer machine according to claim 1, wherein, the elastic component is a pull spring.

8. The cycle type waist slimmer machine according to claim 1, further comprising an elastic component placed between the pressure-resisting component and the elongated rod to enable the user to better massage the abdomen.

* * * * *